US011266176B2

(12) United States Patent
Miah et al.

(10) Patent No.: US 11,266,176 B2
(45) Date of Patent: Mar. 8, 2022

(54) FILTER FOR A SMOKING ARTICLE OR AN AEROSOL GENERATING PRODUCT

(71) Applicant: British American Tobacco (Investments) Limited, London (GB)

(72) Inventors: Rezaul Miah, London (GB); Ignacio Suarez Yanez, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 29 days.

(21) Appl. No.: 16/754,790

(22) PCT Filed: Oct. 23, 2018

(86) PCT No.: PCT/GB2018/053051
§ 371 (c)(1),
(2) Date: Apr. 9, 2020

(87) PCT Pub. No.: WO2019/081905
PCT Pub. Date: May 2, 2019

(65) Prior Publication Data

US 2021/0186086 A1 Jun. 24, 2021

(30) Foreign Application Priority Data

Oct. 25, 2017 (GB) ..... 1717569

(51) Int. Cl.
*A24D 3/06* (2006.01)
*A24D 3/04* (2006.01)
(Continued)

(52) U.S. Cl.
CPC ..... *A24D 3/061* (2013.01); *A24B 15/281* (2013.01); *A24D 3/04* (2013.01); *A24D 3/048* (2013.01); *A24D 3/17* (2020.01)

(58) Field of Classification Search
CPC ..... A24D 3/061
See application file for complete search history.

(56) References Cited

U.S. PATENT DOCUMENTS

2007/0012327 A1* 1/2007 Karies ..... A24C 5/475 131/337
2011/0120481 A1* 5/2011 Besso ..... A24D 3/061 131/275

(Continued)

FOREIGN PATENT DOCUMENTS

JP 2016533764 A 11/2016
RU 2550333 C2 7/2014

(Continued)

OTHER PUBLICATIONS

International Search Report for corresponding application PCT/GB2018/053051 filed Oct. 23, 2018; dated Feb. 5, 2019.

(Continued)

*Primary Examiner* — Eric Yaary
(74) *Attorney, Agent, or Firm* — Cantor Colburn LLP

(57) ABSTRACT

A filter for a smoking article or an aerosol generating product comprising a first filter section and a second filter section, the second filter section being located downstream of the first filter section; the first filter section comprising filter material and two or more capsules comprising additive, the capsules being disposed in an axial region proximal a longitudinal axis of the filter and being spaced in sequence in a direction along the axis; the second filter section comprising at least one channel located in an axial region of the second filter section proximal a longitudinal axis of the filter, to facilitate, in use, drawing of an aerosol through the axial region of the first filter section in which the capsules are disposed.

21 Claims, 1 Drawing Sheet

(51) Int. Cl.
*A24D 3/17* (2020.01)
*A24B 15/28* (2006.01)

(56) References Cited

U.S. PATENT DOCUMENTS

| | | | | |
|---|---|---|---|---|
| 2012/0080043 | A1* | 4/2012 | Naenen | A24D 3/0216<br>131/341 |
| 2015/0296878 | A1* | 10/2015 | Mucalo | A24D 1/02<br>131/335 |
| 2016/0037824 | A1* | 2/2016 | Jordil | A24D 3/062<br>131/337 |
| 2016/0302478 | A1* | 10/2016 | Lavanant | A24D 3/061 |

FOREIGN PATENT DOCUMENTS

| | | | |
|---|---|---|---|
| RU | 2603753 | C2 | 12/2015 |
| WO | 2006117697 | A1 | 11/2006 |
| WO | 2012156705 | A1 | 11/2012 |
| WO | 2013068081 | A1 | 5/2013 |
| WO | 2014023557 | A1 | 2/2014 |
| WO | 2014068295 | A1 | 5/2014 |
| WO | 2016092283 | A1 | 6/2016 |

OTHER PUBLICATIONS

Written Opinion for corresponding application PCT/GB2018/053051 filed Oct. 23, 2018; dated Feb. 5, 2019.
Russian Office Action for corresponding application 2020114445 filed Oct. 23, 2018; Report dated Oct. 28, 2020.
International Preliminary Report on Patentability for corresponding PCT/GB2018/053051 filed Oct. 23, 2018; dated Apr. 28, 2020.

* cited by examiner

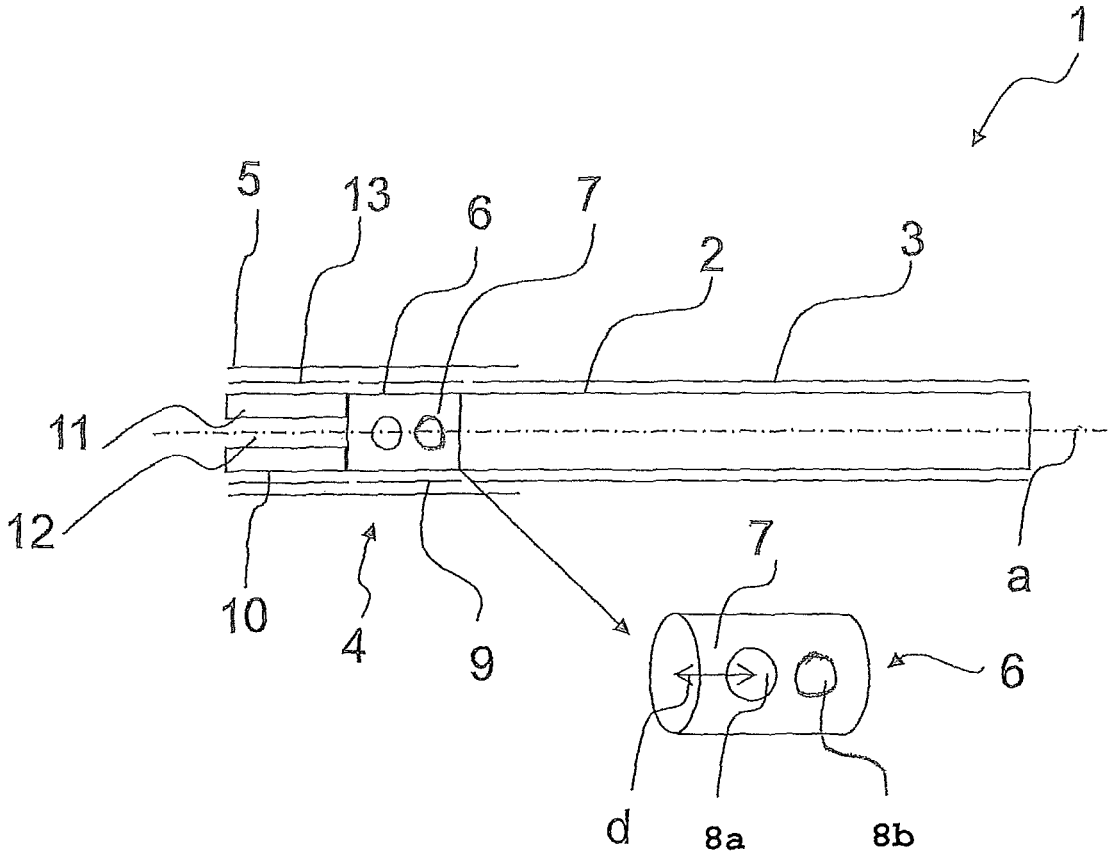
1
5
13
6
7
2
3
11
12
10
4
9
7
a
6
d
8a
8b

FILTER FOR A SMOKING ARTICLE OR AN AEROSOL GENERATING PRODUCT

TECHNICAL FIELD

The invention relates to a filter for a smoking article or an aerosol generating product and to a smoking article/aerosol generating product including a filter.

BACKGROUND

Known smoking article filters, such as cigarette filters, generally comprise a continuous tow of filamentary cellulose acetate. The cellulose acetate is gathered together to form a rod which is cut to form individual filter sections. The smoking article filter may be made of one segment of filter rod, or may be made from multiple segments, with or without a cavity or spaces between them.

SUMMARY

According to embodiments of the invention, there is provided a filter for a smoking article or an aerosol generating product comprising a first filter section and a second filter section, the second filter section being located downstream of the first filter section;

- the first filter section comprising filter material and two or more capsules comprising additive, the capsules being disposed in an axial region proximal a longitudinal axis of the filter and being spaced in sequence in a direction along the axis;
- the second filter section comprising at least one channel located in an axial region of the second filter section proximal a longitudinal axis of the filter, to facilitate, in use, drawing of an aerosol through the axial region of the first filter section in which the capsules are disposed.

The second filter section may comprise filter material, such as cellulose acetate, and the at least one channel is located in an axial region of the filter material.

The at least one channel can have a lower resistance to smoke passing through it than other regions of the filter material of the second filter section. The channel can be a hollow passageway through the second filter section.

The second filter section can be connected to said first filter section so as to make the second filter section immediately downstream of said first filter section when incorporated into a smoking article.

The axial region of said filter material of said first and/or second filter sections can have a radius of from 1 mm to 4 mm and/or can be centred on the axis of the smoking article.

The first filter section can comprise continuous filter material having the capsules disposed in the axial region thereof. The second filter section can comprise a tubular filter section. The tubular filter section can be formed from a fibrous filter material.

The second filter section can be configured, in use, to direct a greater portion of smoke through the axial region of the first filter section than through non-axial regions of the first filter section.

The first filter section can comprise continuous filter material. The first filter section can comprise cellulose acetate filter material. The capsules can be embedded in the filter material. The capsules can be embedded in the cellulose acetate.

The at least one channel of the second filter section can be disposed along the central longitudinal axis of the second filter section. The capsules can be disposed along the central longitudinal axis of the first filter section. In one embodiment, the at least one channel of the second filter section is disposed along the central longitudinal axis of the second filter section and the capsules are disposed along the central longitudinal axis of the first filter section The capsules can be located within the first filter section at a position other than a longitudinally central position within the first filter section. The capsule can be located within the first filter section at a position from 1 mm to 10 mm from a longitudinally central position within the first filter section.

According to embodiments of the invention, there is also provided a smoking article or an aerosol generating product comprising a filter as defined herein.

The second filter section can be arranged immediately downstream of said first filter section and at the mouth-end of the smoking article or the aerosol generating product.

The first filter section comprises two or more capsules containing additive. The additive, such as flavourant, is encapsulated within the capsule. The capsules allow the consumer to release the additive when the first filter section is subjected to an external force. Releasing the additive, such as flavourant, modifies the smoke passing through the filter. Encapsulating the additive can avoid unintentional release or migration of the additive during manufacture or storage.

The capsules can be frangible capsules. Frangible capsules allow the consumer to crush the capsules and release the contents of the capsule, e.g. additive/flavourant. Two capsules can provide the consumer with a choice of which additive/flavourant to release and/or how much additive/flavourant to release. For example, in an embodiment in which the two capsules contain the same additive/flavourant in the same amount, crushing both capsules releases double the amount of additive/flavourant compared to crushing just one capsule. Alternatively, in embodiments having two capsules containing different flavourants, the consumer is provided with a choice of which flavourant to release, or to release both flavourants, e.g. at the same time. Two capsules also increases the range of pressure drops which the filter has to operate at (both capsules crushed, either capsule crushed, or both capsules crushed).

The capsules comprise an additive. For example, the capsules can comprise a flavourant. The two capsules can contain the same flavourant or different flavourants. Where the two capsules contain the same flavourant, the capsules can contain the same amount or different amounts of flavourant.

The flavourant can be a liquid.

The flavourant employed in the capsules can be any flavourant suitable for use in a smoking article filter. For example, the flavourant may enhance the user's experience. Suitable flavours or flavourings include, but are not limited to, menthol, mint, chocolate, liquorice, citrus, redberry, blueberry, mojito, vanilla, spice flavours, plant essential oils, or other fruit flavours. Specific combinations of flavours include, but are not limited to, blueberry and mojito, redberry and menthol, or menthol and blueberry.

The capsules can be of any suitable weight. For example, the capsules can weigh from about 9 mg to about 18 mg, from about 11 mg to about 16 mg, or from about 13 mg to about 14 mg.

The capsules can be located within the first filter section at a position other than a longitudinally central position within the first filter section. The capsule can be located within the first filter section at a position from 1 mm to 10 mm from a longitudinally central position within the first filter section. Alternatively, the capsules can be disposed in sequence along the longitudinal central axis of the first filter section.

The capsule may have any suitable structure in which the additive/flavourant is encapsulated in the capsule. The capsule can comprise an outer shell and an inner core containing the additive/flavourant. The outer shell can be substantially continuous. The outer shell seals the additive/flavourant inside the capsule but the capsule, for example the outer shell, is frangible or breakable to allow the additive/flavourant to be released when an external force is applied to the capsule.

The capsules can have a burst strength of from about 0.8 kp (8 N) to about 2.4 kp (24 N), from about 1.2 kp (12 N) to about 2.0 kp (20 N), from about 1.4 kp (14 N) to about 1.8 kp (18 N), or about 1.60 kp (16 N).

The capsule can have any suitable shape, such as, spherical, spheroid, cylindrical, or ellipsoid. The cross section perpendicular to the axis of the filter can be circular.

The diameter of the capsules is measured as the longest dimension of its cross section perpendicular to the axis of the filter. The diameter of the capsules can be from about 2.0 mm to about 6.0 mm. Alternatively, the diameter of the capsules can be from about 2.2 mm to about 3.8 mm, about 2.4 mm to about 3.4 mm, about 2.6 mm to about 3.2 mm, about 2.7 mm to about 3.1 mm, about 2.8 mm to about 3.0 mm, or 2.8 mm, or 3.0 mm.

The filter material of the first filter section (and if present in the second filter section) may comprise any suitable material or materials, such as cellulose acetate.

The filter material can have any suitable circumference, including but not limited to, from about 16 mm to about 25 mm, from about 16 to about 18 mm, from about 19 mm to about 22 mm, or from about 23 mm to about 25 mm.

The fibers of the filter material can have a fiber denier of from about 3.0 denier per filament (dpf) to about 10.0 dpf, from about 4.5 dpf to about 10.0 dpf, from about 4.5 dpf to about 8.0 dpf, from about 3.0 dpf to about 5.0 dpf, or from about 4.0 dpf to about 5.0 dpf.

The combination of a filter material having a specific circumference with a specific fiber denier has been found to be particularly useful. Certain combinations provide acceptable levels of tar delivery whilst at the same time avoiding crushing of the capsules during the process employed to incorporate the capsules into the filter material.

In one embodiment, the circumference of the filter material of the first filter section can be from about 16 mm to about 18 mm, and the fibers of the filter material have a fiber denier of from about 4.5 dpf to about 10.0 dpf.

In another embodiment, the circumference of the filter material of the first filter section can be from about 19 mm to about 22 mm, and the fibers of the filter material have a fiber denier of from about 4.0 dpf to about 5.0 dpf. For example, the fiber denier can be about 5.0 dpf.

In another embodiment, the circumference of the filter material of the first filter section can be from about 23 mm to about 25 mm, and the fibers of the filter material have a fiber denier of from about 3.0 dpf to about 5.0 dpf. For example, the fiber denier can be about 3.0 dpf.

The filter material can have a total denier of from about 12,000 to about 40,000, from about 15,000 to about 23,000, from about 25,000 to about 35,000, or from about 35,000 to about 40,000.

The combination of a filter material having a specific circumference with a specific total denier has been found to be particularly useful. Certain combinations provide acceptable levels of tar delivery whilst at the same time avoiding crushing of the capsules during the process employed to incorporate the capsules into the filter material.

In one embodiment, the circumference of the filter material of the first filter section can be from about 16 mm to about 18 mm, and the filter material has a total denier of from about 15,000 to about 23,000.

In another embodiment, the circumference of the filter material of the first filter section can be from about 19 mm to about 22 mm, and the filter material has a total denier of from about 30,000 to about 35,000. For example, the total denier can be about 30,000.

In another embodiment, the circumference of the filter material of the first filter section can be from about 23 mm to about 25 mm, and the filter material has a fiber denier of from about 30,000 to about 40,000. For example, the total denier can be about 40,000.

The first filter section can have a resistance to draw (RTD), before the capsule is crushed, of from about 75 mm/Wg to about 100 mm/Wg, or from about 80 mm/Wg to about 95 mm/Wg.

The first filter section can have a resistance to draw (RTD), after the capsule is crushed, of from about 85 mm/Wg to about 110 mm/Wg, from about 90 mm/Wg to about 100 mm/Wg.

In one embodiment, the circumference of the filter material of the first filter section can be from about 16 mm to about 18 mm, and the RTD before the capsule is crushed is from about 110 mm/Wg to about 160 mm/Wg.

In another embodiment, the circumference of the filter material of the first filter section can be from about 19 mm to about 22 mm, and the RTD before the capsule is crushed is from about 86 mm/Wg to about 94 mm/Wg, and/or the RTD after the capsule is crushed is from about 95 mm/Wg to about 100 mm/Wg.

In another embodiment, the circumference of the filter material of the first filter section can be from about 23 mm to about 25 mm, and the RTD before the capsule is crushed is from about 80 mm/Wg to about 85 mm/Wg, and/or the RTD after the capsule is crushed is from about 86 mm/Wg to about 92 mm/Wg A plasticizer can also be added to the fibers. Examples of suitable plasticizers include, but are not limited to, triacetin. The amount of plasticizer added to the fibers can be from about 2% to about 10% or from about 3% to about 6% by weight (wt/wt) of the fibers.

The filter comprises a first filter section and a second filter section, the second filter section being located downstream of the first filter section. The first filter section comprises two capsules, e.g. a first capsule and a second capsule, that are spaced in sequence along the axis of the filter. The second capsule is located downstream of the first capsule when incorporated into a smoking article. In other words, the second capsule is located closest to the mouth end of the smoking article and the first capsule is located furthest from the mouth end of the smoking article.

The capsules can be located in a single segment of the first filter section, or the capsules can be located in two separate segments of the first filter section.

The distance between the capsules, i.e. between the first capsule and the second capsules, can be any suitable distance. For example, the distance between the capsules can be from about 8 mm to about 12 mm, from about 7 mm to about 11 mm, from about 8 mm to about 10 mm, or about 9 mm.

The length of the first filter section can be from about 16 mm to about 24 mm, from about 18 to about 22 mm, or about 20 mm. The length of the first filter section is measured parallel to the axis of the filter.

The two capsules can be equally spaced within the first filter section. Alternatively, the capsules can be unevenly spaced within the first filter section. For example, the distance between the first and second capsules can be greater than the distance from the centre of the second capsule to the downstream end of the first filter section and/or greater than the distance from the first capsule to the upstream end of the first filter section.

For example, the distance from the first capsule to the second capsule can be from about 8 mm to about 10 mm, or about 9 mm. For example, the distance from the second capsule to the downstream end of the first filter section is from about 5 mm to about 7 mm, or about 6 mm. For example, the distance from the first capsule to the upstream end of the first filter section is from about 4 mm to about 6 mm, or about 5 mm. The distance from the second capsule to the downstream end of the first filter section can be greater than the distance from the first capsule to the upstream end of the first filter section. For example, the distance from the second capsule to the downstream end of the first filter section is greater than the distance from the first capsule to the upstream end of the first filter by about 0.5 mm to about 1.5 mm, or about 1 mm. In one embodiment, the distance between the first capsule and the second capsule is from about 8 mm to about 10 mm, the distance from the second capsule to the downstream end of the first filter section is from about 5 mm to about 7 mm, and the distance from the first capsule to the upstream end of the first filter section is from about 4 mm to about 6 mm, provided that the distance from the second capsule to the downstream end of the first filter section is greater than the distance from the first capsule to the upstream end of the first filter section. The length of the second filter section can be from about 4 mm to about 10 mm, from about 5 mm to about 9 mm, from about 6 mm to about 8 mm, or about 7 mm. The combined length of the first filter section and the second filter section can be from about 20 mm to about 34 mm, from about 21 mm to about 33 mm, from about 23 mm to about 31 mm, from about 25 mm to about 29 mm, or about 27 mm.

The capsules can be surrounded by filtration material.

The capsule can be elongate. The capsule can have a longitudinal axis which is parallel to an axial direction of the smoking article or filter in which the capsule is located. The capsule can be substantially tubular, and have a maximum cross-sectional area defined in a plane perpendicular to the longitudinal axis. The cross-sectional area of the capsule can be substantially constant along a majority of the length of the capsule. Alternatively, the cross-sectional area of the capsule may vary along its length. The term "elongate" may be considered to mean that the dimension of the capsule in one direction is substantially greater than the dimension of the capsule in the two perpendicular directions. The longer dimension is beyond manufacturing tolerances for a substantially spherical capsule. For example, the longer dimension may be at least 1.5 times the maximum lateral dimension, or at least two times the maximum lateral dimension.

The capsule can have an exterior surface which is substantially cylindrical. The longitudinal ends can be rounded, for example, such that the ends are substantially hemispherical. The capsule can comprise an outer wall and an inner volume filled with the fluid. The additive can be selectively released by the user of the smoking article into the adjacent filtration material by squeezing the outside of the filter to deform or rupture the outer wall of the capsule.

The capsule can be configured to release all of the additive contents when the outer wall is ruptured. Alternatively, the capsule can be configured to release only a part of the additive on inward pressure from a user, such that the capsule is configured to release the additive contents in a plurality of discrete deliveries.

A known smoking article or an aerosol generating product can generally have a maximum lateral dimension, which is a diameter for a circular cross-section. In the case of a cigarette in the superslim format, or a filter therefor, the maximum lateral dimension, or diameter, may be 5-6 mm, for example, approximately 5.4 mm, which may be known as a superslim. The filter will normally be marginally smaller in diameter than the filter, in order to accommodate wrapping paper. A spherical capsule may have a diameter which is a relatively large proportion of the cross-sectional area of the filter. The capsule may cause an adverse effect on smoke flow rate and/or pressure drop. The capsule may have a relatively small diameter, such that the effect of the capsule on the properties of the filter is reduced. The capsule can be elongate, instead of spherical, such that a sufficient quantity of additive can be contained. The maximum lateral dimension of the capsule is less than 4 mm, or less than 3.5 mm, and preferably from 2.2 mm to 2.8 mm. Elongate capsules may have lengths of from 7 mm to 11 mm, e.g. from 8 mm to 10 mm or approximately 9 mm. Alternatively, the length may be from 5 mm to 7 mm, e.g. approximately 5.5 mm.

The combination of an capsule with a maximum lateral dimension (diameter) of less than 3.5 mm, in a smoking article or filter having a slim, demi-slim or superslim format provides a required quantity of additive and affects the smoke flow rate and/or pressure drop within an acceptable threshold. The particular dimensions (lateral and length) of the elongate capsule, in a smoking article of these small diameter formats provides an advantageous combination of parameters which provide the required quantity of additive without significantly affecting the pressure drop.

Alternatively, the capsule can have a shape which is not elongate. In some aspects, the capsule may be spherical or substantially spherical. For a particular maximum lateral dimension (diameter), a spherical capsule may be able to contain less quantity of additive than an elongate capsule. For a smaller diameter of filter or smoking article, the reduced quantity of additive can be substantially as effective as a higher quantity of additive in a larger diameter filter or smoking article. The smaller diameter of filter or smoking article can have a maximum lateral dimension less than 7.6 mm or less than 7 mm, or any range specified in any embodiment. The diameter of the spherical capsule can be less than 3.5 mm, or any range of diameter specified in any embodiment. The radial dimensions apply to both elongate and spherical capsules.

A length of the capsule can be from 4 mm to 15 mm. The capsule has an exterior length from 7 mm to 11 mm, and in some aspects, from 8 mm to 10 mm, or approximately 9 mm.

Alternatively, the capsule can have an exterior length from 4 mm to 15 mm, and in some aspects, from 5 mm to 7 mm, or from 5 mm to 6 mm. In some aspects, the capsule length is approximately 5.5 mm. The capsule maximum lateral extent can be from 2.2 mm to 2.8 mm, and is preferably approximately 2.5 mm.

Alternatively, the length of the capsule is from 11 mm to 15 mm, or from 12 to 14 mm, or approximately 13.6 mm. The capsule maximum lateral extent can be from 2.2 mm to 2.8 mm, and is approximately 2.5 mm.

Alternatively, the exterior maximum lateral extent, or diameter for a circular cross-section, of the capsule of any type or embodiment may be within the range 4.5 mm to 7 mm. The maximum lateral extent may be less than 7 mm, less than 6 mm, less than 5 mm or less than 4 mm. The maximum lateral extent may be between 3 mm and 4 mm.

In particular, the maximum lateral extent of the capsule may be between 3 mm and 4 mm (e.g. approximately 3.5 mm) in combination with a filter/smoking article having a diameter of between 5 mm and 6 mm (e.g. approximately 5.4 mm). The maximum lateral extent may be greater than 1 mm, in combination with any upper limit, capacity or relative cross-sectional area.

These dimensions may apply to any type of capsule. The larger length additive release component can be used with an capsule comprising a substrate. The substrate may contain approximately 40% of additive by volume.

The diameter and length of the capsule determines the maximum volume of additive which can be contained. Therefore, the selection of a relatively small diameter can be used in combination with a relatively high length in order to contain a required quantity of additive. Any combination of dimensions, including dimensions outside of the ranges indicated, may be used. The outer shell of any embodiment can have a thickness of approximately 0.2 mm.

The smoking articles or filters containing the capsule can have a diameter of from 4 mm to 10 mm, for example from 5 mm to 7 mm, or y from 5 mm to 6 mm, or from 5.1 mm to 6 mm (superslim). In some aspects, from 5.2 mm to 5.6 mm, or from 5.3 mm to 5.5 mm, for example approximately 5.4 mm. Where the smoking article or filter is in the slim, demislim, superslim or microslim format, it can have a diameter of less than about 7.6, 7.0, 6.0 and 5.1 mm respectively (corresponding approximately to circumferences less than 24, 22, 19 and 16 mm respectively). Where the smoking article or filter is in the regular format, it can have a diameter of 7.6-8.0 mm (corresponding approximately to a circumference of 24-25 mm) So called "wide" formats can have, diameters larger than 8.0 mm (corresponding approximately to circumferences greater than 25 mm).

The small lateral extent of the capsule may be advantageous for reducing pressure drop in any diameter smoking article, although the advantage has a particular effect for the smaller diameter smoking article. The invention is applicable to any diameter of smoking article or filter in combination with a relatively sized capsule. For example, the smoking article may have a diameter of from one of: 5 mm, 5.3 mm, 5.5 mm, 6 mm, 6.5 mm, 7 mm, 7.3 mm, 7.5 mm, 7.7 mm, 8 mm to one of 5.5 mm, 6 mm, 6.5 mm, 7 mm, 7.5 mm, 7.9 mm, 8.5 mm, in an any combination.

The capsule may have an additive capacity from 3 μL to 50 μL, or from 3 μL to 10 μL, or from 10 μL to 30 μL, and optionally from 15 μL to 25 μL or from 20 μL to 30 μL or from 8 μL to 20 μL, or approximately 20 μL or approximately 30 μL. Any upper or lower value of capacity may be used in combination. In particular, the capacity of the capsule may be from one of: 3 μL, 5 μL, 8 μL, 10 μL, 15 μL, 20 μL, 25 μL, 30 μL, 35 μL, 40 μL to one of: 5 μL, 8 μL, 10 μL, 15 μL, 20 μL, 25 μL, 30 μL, 35 μL, 40 μL, 45 μL, 50 μL.

Alternatively, the maximum lateral extent of the capsule may be one of from: 1.5 mm to 2.5 mm, 1.5 mm to 3 mm, 1.5 mm to 3.5 mm, 2 mm to 2.5 mm, 2 mm to 3 mm, 2 mm to 3.5 mm, 2.5 mm to 3 mm, 2.5 mm to 3.5 mm, 3 mm to 4 mm, 3.5 mm to 4 mm. The maximum lateral extent of the additive release component may be from a lower lateral extent of one of 1.0 mm, 1.1 mm, 1.2 mm, 1.3 mm, 1.4 mm, 1.5 mm, 1.6 mm, 1.7 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm and to a higher lateral extent of one of: 1.6 mm, 1.7 mm, 1.8 mm, 1.9 mm, 2.0 mm, 2.1 mm, 2.2 mm, 2.3 mm, 2.4 mm, 2.5 mm, 2.6 mm, 2.7 mm, 2.8 mm, 2.9 mm, 3.0 mm, 3.1 mm, 3.2 mm, 3.3 mm, 3.4 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 mm, 4.8 mm, 4.9 mm, 5.0 mm, 5.1 mm, 5.2 mm, 5.3 mm, 5.4 mm, 5.5 mm, 5.6 mm, 5.7 mm, 5.8 mm, 5.9 mm, 6.0 mm, 6.1 mm, 6.2 mm, 6.3 mm, 6.4 mm, 6.5 mm, 6.6 mm, 6.7 mm, 6.8 mm, 6.9 mm, 7.0 mm, 7.1 mm, 7.2 mm, 7.3 mm, 7.4 mm, 7.5 mm, 7.6 mm, 7.7 mm, 7.8 mm, 7.9 mm, 8.0 mm in any combination.

These ranges are not, however, intended to be limiting and the skilled person would understand that larger or smaller filter or capsules could be employed. References to diameter indicate the maximum lateral dimension of the capsule. For a capsule which is not circular in cross-section, the diameter values above indicate the maximum lateral dimension of the capsule.

The capsule has a maximum radial cross-sectional area. The area of the capsule relative to the radial cross-sectional area of the section of the smoking article containing the capsule may determine whether the restriction of smoke flow or pressure drop due to the capsule is within acceptable limits. In some aspects, the capsule can be less than 50% of the radial cross-sectional area of the section containing the capsule, for example less than 45%, less than 40%, less than 35%, less than 30%, less than 25%, less than 20%, less than 15%, or less than 10%. Alternatively, maximum radial cross-sectional area of the capsule may be less than 65%, less than 60%, or less than 55% of that of the section of the cigarette of filter containing the component. The cross-sectional area of the capsule may be higher than 5%, 10%, 15%, 20%, 25%, 30%, 35%, 40%, or 45% of the filter or smoking article, in combination with any upper limit.

Alternatively, the maximum radial cross-sectional area of the capsule, expressed as a percentage of the radial cross-sectional area of the section of the smoking article or filter containing the additive release component, may be more than 50%. The ratio may be less than 55%, 60%, 65%, 70%, 75%, 80%, 85%, 90% or 95%. Alternatively, the ratio may be more than 5%, 10%, 15%, 20% 25%, 30%, 35%, 40%, 45%, 50%, 55%, 60%, 65%, 70%, 75%, 80%, 85%, 90% or 95%.

The invention may comprise filters and smoking articles, particularly cigarettes, in which the maximum radial cross-sectional area of the capsule expressed as a percentage of the radial cross-sectional area of the section containing the capsule lies in a range between any two values described above.

This range may be from 15% to 50%, or In some aspects, from 20% to 35%, or from 30% to 45%, or from 25% to 40%, or from 30% to 40%.

In particular, where a capsule has the above area relative to a section of the smoking article containing the capsule, the diameter of that section may be less than 8 mm, less than 7.5 mm, less than 7 mm, or less than 6 mm. For example, the section of the smoking article containing the capsule may have a diameter of from 5 mm to 6 mm, or from 6 mm to 7 mm, or from 5 mm to 7.5 mm. Alternatively, the diameter of this section of the smoking article may be greater than 8 mm.

The capsule may have a maximum lateral cross-sectional area of less than 40 $mm^2$, less than 30 $mm^2$, less than 20 $mm^2$, less than 15 $mm^2$, and in some aspects, less than 10 $mm^2$, less than 8 $mm^2$, less than 6 $mm^2$, less than 5 $mm^2$.

The lateral cross-sectional area may be greater than 1 $mm^2$, 2 $mm^2$, 3 $mm^2$, 4 $mm^2$, 5 $mm^2$ or 6 $mm^2$, in combination with any upper limit.

The filter can further comprise a third filter section connected to said first filter section so as to make it upstream of said first filter section when incorporated into a smoking article. The third filter section can be a discrete filter section. The third filter section can comprise fibrous filter material and a granular adsorbent material. The granular adsorbent material can be disposed in a circumferential region of the third filter section, dispersed within the filter material of the third filter section, or comprises some granular adsorbent material disposed in a circumferential region of the third filter section and some granular adsorbent material dispersed within the third filter section.

BRIEF DESCRIPTION OF THE DRAWINGS

Embodiments of the invention will now be described, by way of example only, with reference to the accompanying drawings, in which:

FIG. 1 is a schematic illustration of a smoking article having a filter with a tubular downstream filter section and an upstream filter section including an encapsulated additive in the form of a frangible capsule;

DETAILED DESCRIPTION

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn/tobacco heated products and aerosol generating products such as e-cigarettes.

For convenience, these will be referred to as "smoking articles" in this specification. The term "aerosol" covers smoke, e.g. tobacco smoke. Such smoking articles may be provided with a filter for the gaseous flow drawn by the smoker.

The term "smoking article" includes cigarettes, cigars and cigarillos as well as roll-your-own-products and make-your-own products.

Smoking articles such as cigarettes and their formats are often named according to the cigarette length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the cigarette circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm). Accordingly, a cigarette in a king-size, super-slim format will, for example, have a length of about 83 mm and a circumference of about 17 mm. Cigarettes in the regular, king-size format are preferred by many customers, namely with a circumference of from 23 to 25 mm and an overall length of from 75 to 91 mm.

Each format may be produced with filters of different lengths, smaller filters being generally used in formats of smaller lengths and circumferences. Typically the filter length will be from 15 mm, associated with short, regular formats, to 30 mm, associated with ultra-long super-slim formats. The tipping paper will have a greater length than the filter, for example from 3 to 10 mm longer.

Smoking articles and filters described hereinafter can be manufactured in any of the above formats. The smoking article can, for instance, be from 70 to 100 mm in length and from 14 to 25 mm in circumference.

The terms 'upstream' and 'downstream' used herein are relative terms defined in relation to the direction of mainstream smoke (or other aerosol) drawn though a smoking article in use.

Herein, distances measured from or to the first or second capsules are measured from or to the centre of the first or second capsules.

Herein, the units "mm/Wg" refer to millimetres/water gauge (also known as mm $H_2O$). Herein, these measurements were carried out on individual filter sections.

FIG. 1 is a schematic illustration of a smoking article 1 which is generally cylindrical in shape and is in the regular, king size format, namely having a length in the range 75-91 mm and a circumference in the range 23 to 25 mm. The smoking article 1 includes a tobacco rod 2 wrapped in a wrapping material 3, in this example cigarette paper, connected longitudinally to a filter 4 by tipping material 5 overlaying the filter 4 and partially overlaying the wrapping material 3 so as to connect the filter 4 to the tobacco rod 2. The filter 4 comprises a first section 6 at the tobacco rod end of the filter 4 comprising absorbent material 7 having capsules 8*a*, 8*b* disposed therein in an axial region of the filter material of the first section 6. The axial region is a region, in the present example, centred on the axis 'a' of the smoking article 1, having a radius of about 3 mm. In alternative embodiments, the radius of the axial region can be anywhere from 1 mm to 4 mm, or from 1 mm to 3 mm, or about 1 mm, 1.5 mm, 2 mm, 2.5 mm, 3 mm or 3.5 mm. Capsules 8*a* and 8*b* are spaced in sequence along the axial region. The capsules 8*a* and 8*b* can be disposed only in the axial region of the filter material of the first filter section 6, or can be disposed in greater concentration in the axial region than in non-axial regions of the filter material of the first filter section 6. The first section is wrapped in a first plug wrap 9.

The filter 4 further comprises a second section 10 at the mouth-end of the filter 4 comprising fibrous filter material 11 formed into a tubular shape and having a channel 12 extending through the centre of the filter material 11. The empty or hollow channel 12 extending through the centre of the filter material 11 can be from 1 mm to 6 mm in diameter, for instance from 2 mm to 5 mm in diameter. The channel 12 extending through the centre of the filter material 11 is, in the present example, an empty, hollow passageway. The channel, in some embodiments, extends through an axial region of the filter material of the second filter section 10. The axial region of the second filter section 10 is a region, in the present example, centred on the axis 'a' of the smoking article 1, having a radius of about 2.5 mm. In alternative embodiments, the radius of the axial region can be anywhere from 1 mm to 4 mm, or from 1 mm to 3 mm, or about 1 mm, 1.5 mm, 2 mm, 2.5 mm, 3 mm or 3.5 mm. In the present example, the tubular filter section is formed from cellulose acetate tow and is wrapped in a second plug wrap 13. The wall thickness of the tubular filter is about 1.5 mm. In alternative embodiments, the wall thickness can be anywhere from 1 mm to 4 mm, or from 1 mm to 3 mm, or about 1 mm, 1.5 mm, 2 mm, 2.5 mm, 3 mm or 3.5 mm. However, the specific dimensions may be selected based on the density of filter material forming the tube and the level of plasticiser applied to the material, to result in a tube having the desired rigidity, porosity or other characteristics. The tubular filter section 10 can be manufactured using existing processes and machinery.

The first segment 6 is a cellulose acetate segment formed using continuous cellulose acetate fibres and a plasticiser. The capsules 8*a* and 8*b* are spherical and have a diameter of 2.8 mm, although other shapes and sizes of capsule can be used, and contains a fluid additive which modifies properties of mainstream smoke passing through the smoking article 1. The capsules 8*a* and 8*b* can be manufactured and inserted into the first filter section 6 using existing processes and machinery. In the present example, the capsules 8*a* and 8*b* contain menthol flavourant, although other fluids or granular additives could be contained within the capsules 8*a* and 8*b*. The capsules can be ruptured by a consumer to release the fluid additive into the absorbent filter material 11.

The axis of the smoking article 1, about which the tobacco rod 2 and first and second filter sections 6, 10 are aligned, is indicated as 'a' in FIG. 1.

In the present example, the capsules 8*a* and 8*b* are located in an 'axial region' of the first filter section 6, as defined above. The capsules 8*a* and 8*b* can be located such that the centre of the capsule is closer to the axis 'a' of the smoking article 1 than to the outer periphery of the smoking article 1. In the present example, the capsules 8*a* and 8*b* are located with its centre substantially along the axis 'a'. In the present example, the capsule 8*a* is offset from the longitudinal centre of the first filter section 6. The capsule 8*a* can, for instance, be located within the first filter section 6 at a position from 1 mm to 10 mm from a longitudinally central position within the first filter section 6. The capsule 8*a* is located within a portion of the first filter section 6 closer to the downstream end of the first filter section 6. The capsule 8*a* is therefore closer to the second filter section 10 than to the tobacco rod 2. In particular, the distance 'd' between the centre of the capsule 8*a* and the downstream end of the first filter section 6 is less than half of the total longitudinal length of the first filter section 6. In some embodiments, the distance 'd' is less than 40%, less than 30% or less than 25% of the total longitudinal length of the first filter section 6. In the present example, the distance 'd' is approximately 30% of the total longitudinal length of the first filter section 6. In alternative embodiments, the capsule 8*a* can be located longitudinally centrally within the first filter section 6 or closer to the upstream end of the first filter section 6 than to the downstream end.

In use, the tobacco rod 2 of the smoking article 1 is lit by a consumer in the conventional manner and tobacco smoke is drawn from burning coal of the tobacco rod 2 through the filter 4. The channel 12 in the second filter section 10 has a lower resistance to mainstream smoke passing through the filter 4 than the surrounding tubular filter material 11, and therefore a greater proportion of mainstream smoke is directed through the channel 12. This, in turn, results in a greater flow of mainstream smoke in the axial region around the axis 'a' of the first filter section 6, in which the capsules 8*a* and 8*b* are located. When the consumer breaks the capsule 8*a* and/or capsule 8*b* either prior to or in the course of smoking the smoking article 1, the additive contained therein, in the present case menthol, is released in greater concentration into the axial region of the first filter section 6 through which an increased flow of mainstream smoke is directed, as a result of the second filter section 10. Accordingly, the increased flow of mainstream smoke enhances the delivery of the smoke modifying additive to the consumer and the smoking article 1 can therefore exhibit improved delivery of a smoke modifying additive to a consumer compared to conventional smoking articles.

The use of the tubular second section 10 at the mouth end of the smoking article 1 enables the capsules 8*a* and 8*b* to be located closer to the mouth-end of the smoking article 1 than would be possible if the first section 6 containing the capsules 8*a* and 8*b* were at the mouth end of the smoking article 1. This is because the tube separates the first section 6 from the consumer's mouth, preventing the content from the capsules 8*a* and 8*b* from contacting the consumer's mouth.

Specific embodiments of the invention have been described, although the invention is not limited to such embodiments. For instance, although the second filter section has been described above as a tubular portion of fibrous filter material, this may take other forms, such as filter material sections with lower density regions extending through an axial region thereof. Also, the tubular section or other section having reduced density in an axial region has been described as being at the mouth-end of the filter in some embodiments above, but in any of the embodiments can alternatively be used as a central or upstream end of multipart filters, for instance upstream of the section in which the smoke modifying additive is located, while still benefiting from the effect of the invention. In particular, the presence of such a filter section can encourage mainstream smoke to be directed to an axial region of a smoking article both upstream and downstream of the region, due to the lower resistance to draw coinciding with the axial region.

The first, second and (where present) third filter sections described above can be discrete segments. Although the first, second and (where present) third filter sections described above are connected together using tipping material, they can be individually separate and distinct following their formation and prior to being connected together. The tipping material also connects the filter sections to the respective tobacco rod of each embodiment. In alternative examples of each of the described embodiments, a further plug wrap can be used to connect the first, second and (where present) third filter sections before they are connected to the tobacco rods using the tipping material.

In order to address various issues and advance the art, the entirety of this disclosure shows by way of illustration various embodiments in which the claimed invention(s) may be practiced and provide for superior delivery of a smoke modifying additives. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A filter for a smoking article or an aerosol generating product comprising a first filter section and a second filter section, the second filter section being located downstream of the first filter section;

the first filter section comprising filter material and two or more capsules having a diameter of from about 2 mm to about 6 mm and comprising additive, the capsules being embedded in the filter material and disposed in an axial region proximal a longitudinal axis of the filter and being spaced in sequence in a direction along the axis;

the second filter section comprising at least one channel located in an axial region of the second filter section proximal a longitudinal axis of the filter, to facilitate, in use, drawing of an aerosol through the axial region of the first filter section in which the capsules are disposed, wherein the filter material of the first filter section has a circumference of from about 16 mm to about 19 mm, has fibers having about 4.5 dpf to about 8 dpf, and has a total denier of from about 15,000 to about 25,000.

2. A filter according to claim 1, wherein the capsules contain flavourants.

3. A filter according to claim 2, wherein the flavourant is liquid.

4. A filter according to claim 2 or claim 3, wherein the flavourant in one of said capsules differs from the flavourant in another of said capsules.

5. A filter according to claim 1, wherein the pressure drop of the first filter section, before the capsule is burst, is from about 85 mm/Wg to about 100 mm/Wg.

6. A filter according to claim 1, wherein said channel is a hollow passageway through the second filter section.

7. A filter according to claim 1, wherein the second filter section is connected to said first filter section so as to make the second filter section immediately downstream of said first filter section when incorporated into a smoking article.

8. A filter according to claim 1, wherein the second filter section comprises a tubular filter section.

9. A filter for a smoking article or an aerosol generating product comprising a first filter section and a second filter section, the second filter section being located downstream of the first filter section;

the first filter section comprising filter material and two or more capsules comprising additive, the capsules being embedded in the filter material and disposed in an axial region proximal a longitudinal axis of the filter and being spaced in sequence in a direction along the axis;

the second filter section comprising at least one channel located in an axial region of the second filter section proximal a longitudinal axis of the filter, to facilitate, in use, drawing of an aerosol through the axial region of the first filter section in which the capsules are disposed;

wherein the filter material of the first filter section has a circumference of from about 20 mm to about 22 mm, has fibers having about 4.0 dpf to about 5.0 dpf, and has a total denier of from about 30,000 to about 35,000; and the capsules have a diameter of from about 2 mm to about 6 mm.

10. A filter for a smoking article or an aerosol generating product comprising a first filter section and a second filter section, the second filter section being located downstream of the first filter section;

the first filter section comprising filter material and two or more capsules comprising additive, the capsules being embedded in the filter material and disposed in an axial region proximal a longitudinal axis of the filter and being spaced in sequence in a direction along the axis;

the second filter section comprising at least one channel located in an axial region of the second filter section proximal a longitudinal axis of the filter, to facilitate, in use, drawing of an aerosol through the axial region of the first filter section in which the capsules are disposed;

wherein the filter material of the first filter section has a circumference of from about 23 mm to about 25 mm, has fibers having about 3.0 dpf to about 5.0 dpf, and has a total denier of from about 35,000 to about 40,000 total denier; and the capsules have a diameter of from about 2 mm to about 6 mm.

11. A filter according to claim 1, wherein each capsule comprises a different additive.

12. A filter according to claim 1, wherein the capsules have a diameter from about 2.8 mm to about 3.0 mm.

13. A filter according to claim 1, wherein the first filter section has a resistance to draw (RTD), before the capsule is crushed, of from about 80 mm/Wg to about 95 mm/Wg and a resistance to draw (RTD), after the capsule is crushed, of from about 90 mm/Wg to about 100 mm/Wg.

14. A filter according to claim 1, wherein the capsules are disposed along the central longitudinal axis of the filter.

15. A smoking article or an aerosol generating product comprising a filter according to claim 1.

16. A smoking article or an aerosol generating product according to claim 15, wherein the second filter section is arranged immediately downstream of said first filter section and at the mouth-end of the smoking article/ aerosol generating product.

17. A filter according to claim 9, wherein the capsules have a burst strength of from about 14 N to about 18 N.

18. A filter according to claim 10, wherein the capsules have a burst strength of from about 14 N to about 18 N.

19. A filter according to any one of claim 1, wherein the capsules are spherical and have a diameter of from about 2.7 mm to about 3.1 mm.

20. A filter according to any one of claim 9, wherein the capsules are spherical and have a diameter of from about 2.7 mm to about 3.1 mm.

21. A filter according to any one of claim 10, wherein the capsules are spherical and have a diameter of from about 2.7 mm to about 3.1 mm.

* * * * *